US006712005B2

(12) United States Patent
Heitmann

(10) Patent No.: US 6,712,005 B2
(45) Date of Patent: Mar. 30, 2004

(54) PROJECTILE

(75) Inventor: Thomas Heitmann, Unterlüss (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 10/302,858

(22) Filed: Nov. 25, 2002

(65) Prior Publication Data

US 2003/0167957 A1 Sep. 11, 2003

(30) Foreign Application Priority Data

Nov. 24, 2001 (DE) ..... 101 57 668

(51) Int. Cl.[7] ..... F42B 10/00
(52) U.S. Cl. ..... 102/439; 102/521
(58) Field of Search ..... 102/520–527, 102/439, 521

(56) References Cited

U.S. PATENT DOCUMENTS

| | | | | | |
|---|---|---|---|---|---|
| 3,572,729 | A | * | 3/1971 | Hodil, Jr. | 277/647 |
| 3,961,580 | A | * | 6/1976 | Burnett et al. | 102/520 |
| 4,029,018 | A | * | 6/1977 | Bjornson | 102/521 |
| 4,109,582 | A | * | 8/1978 | Haep et al. | 102/526 |
| 4,187,783 | A | * | 2/1980 | Campoli et al. | 102/520 |
| 4,385,561 | A | * | 5/1983 | Madderra | 102/523 |
| 4,444,113 | A | * | 4/1984 | Campoli | 102/430 |
| 4,532,868 | A | * | 8/1985 | Gleichaut et al. | 102/527 |
| 4,552,071 | A | * | 11/1985 | Horais et al. | 102/527 |
| 4,800,816 | A | * | 1/1989 | Meyer | 102/523 |
| 4,802,415 | A | * | 2/1989 | Clarke et al. | 102/434 |
| 4,833,995 | A | * | 5/1989 | Gotz et al. | 102/521 |
| 4,907,513 | A | * | 3/1990 | Manion et al. | 102/527 |
| 5,025,731 | A | * | 6/1991 | Meyer et al. | 102/521 |
| 5,081,931 | A | * | 1/1992 | Frye et al. | 102/489 |
| 5,313,889 | A | * | 5/1994 | Wilkerson et al. | 102/439 |
| 5,359,938 | A | * | 11/1994 | Campoli et al. | 102/521 |
| 5,492,064 | A | * | 2/1996 | Boutet | 102/520 |
| 5,682,011 | A | * | 10/1997 | Sabranski et al. | 102/527 |
| 6,085,660 | A | * | 7/2000 | Campoli et al. | 102/439 |
| 6,295,934 | B1 | * | 10/2001 | Tepera et al. | 102/525 |
| 6,401,622 | B1 | * | 6/2002 | Brinkmann | 102/524 |
| 6,412,419 | B1 | * | 7/2002 | Brinkmann | 102/524 |
| 6,453,821 | B1 | * | 9/2002 | Fowler et al. | 102/527 |

FOREIGN PATENT DOCUMENTS

| | | | |
|---|---|---|---|
| AU | 0118999 | * | 9/1944 |
| CZ | 70301 | * | 12/1941 |
| GB | 058794 | * | 2/1947 |

* cited by examiner

*Primary Examiner*—Michael J. Carone
*Assistant Examiner*—Troy Chambers
(74) *Attorney, Agent, or Firm*—Venable LLP; Stuart I. Smith

(57) ABSTRACT

A projectile to be fired from a gun having a chamber (2) with a conical transition region (4) to a caliber barrel (3) that adjoins the front of the gun. The projectile (5) has a sub-caliber penetrator (6), a jettisonable propelling cage sabot (7) connected to the penetrator (6), and at least one guide band (10) adapted to the caliber barrel (3) secured to the rear side or portion of the sabot. To ensure that the rear region of the propelling cage sabot (7) seals the chamber (2) against propellant gases that are pushing forward, even if the guide band (10) itself is still located in the chamber, an additional sealing ring (14; 17), comprising a deformable plastic, is provided on the existing guide band (10) adapted to the caliber of the barrel (3). The sealing ring assumes the function of providing the initial seal after the cartridge is ignited.

9 Claims, 2 Drawing Sheets

PROJECTILE

CROSS-REFERENCE TO RELATED APPLICATIONS

This application is based on and claims the priority date of German Application No. 101 57 668.4, filed on Nov. 24, 2001.

BACKGROUND OF THE INVENTION

The invention relates to a projectile to be fired from a gun having a chamber with a conical transition to a caliber barrel at the front of the gun, with the projectile having a sub-caliber penetrator and a jettisonable propelling cage sabot that is connected to the penetrator and has at least one guide band that is adapted to the caliber of the barrel secured to a rear portion or side of the sabot.

In modern gun systems, both the gun and the ammunition are usually developed simultaneously and correspond to one another. In these weapons systems, therefore, it often occurs that existing ammunition of the same barrel caliber cannot be fired with the new gun, because when the projectile is loaded, its guide band is still located in the chamber and not in the caliber barrel. In these cases, the initial seal against propellant gases that flow toward the front is inadequate during firing, so the projectiles are insufficiently accelerated in the gun barrel, and fail to hit their targets properly.

If, in contrast, the guide bands are eliminated from the existing ammunition, and replaced with a kind of guide band that assure a seal against propellant gases while the respective guide band is still in the chamber, the problem arises of strong radial forces acting on the projectile in the caliber barrel due to the large outer diameter of such guide bands. These forces may result in fractures in the propelling cage sabots.

SUMMARY OF THE INVENTION

It is therefor the object of the invention to provide a projectile of the type mentioned at the outset, in which the rear region of the propelling cage sabot seals the chamber against propellant gases that are pushing forward, even if the guide band itself is still located in the chamber, and which avoids the occurrence of radial pressing forces in the caliber barrel that may lead to the destruction of the propelling cage sabot.

The above object generally is achieved according to the present invention by a projectile to be fired from a gun having a cartridge chamber with a conical transition region to a caliber barrel that adjoins a front of the gun. The projectile comprises a sub-caliber penetrator, a jettisonable or discardable propelling cage sabot connected to the penetrator, at least one guide band adapted to the caliber of the barrel secured to a rear portion of the sabot, and a cartridge casing disposed at the rear of the sabot, with the length of the projectile being such that the guide band is still located in the chamber of the barrel when the projectile is disposed in the gun barrel. A sealing ring is disposed on the outer circumferential surface of the guide band for sealing the caliber side of the chamber, with the sealing ring being formed of a plastic material selected such that at least a front part of the sealing ring is destroyed by radial pressure occurring in the conical transition region between the chamber and the caliber barrel as the projectile moves toward the muzzle of the gun barrel. Further, particularly advantageous, embodiments and features of the invention are disclosed.

The invention is essentially based on the concept of providing an additional sealing ring, comprising a deformable plastic, on the existing guide band that is adapted to the caliber of the barrel. After the cartridge has been ignited, this sealing ring assumes the function of providing the initial seal. This sealing ring is then compressed to the caliber diameter in the conical transition region between the chamber and the caliber barrel, and its front part is destroyed in the process. The remainder of the sealing ring is then flattened toward the back. As the projectile continues to travel through the barrel, the provided guide band assumes the sealing function relative to the rear-side propellant gases in a known manner.

Materials that have proven especially effective for the sealing ring are non-reinforced thermoplastic plastics, such as PA6 (Polyamide 6), because they can be produced economically and easily (using injection technology) and, unlike fiber-reinforced plastics, for example, do not damage the gun barrel.

To assure a defined destruction of the sealing ring with a predetermined radial pressure, it has proven advantageous to provide the sealing ring with weakened defined break-off points.

For an economical mounting of the sealing ring to the guide band, the sealing ring can advantageously be connected to the guide band via a snap connection.

The rear part of the sealing ring should be provided with a direct connecting means to the cartridge casing. This can eliminate a conventional cartridge cover. The sealing ring and the cartridge casing likewise can be connected to one another via a snap connection. If necessary, the sealing ring and the cartridge casing can additionally be glued together in the region of the snap connection.

Further details about and advantages of the invention ensue from the following description of exemplary embodiments illustrated in the figures.

DESCRIPTION OF THE PREFERRED EMBODIMENTS

Figure 1:
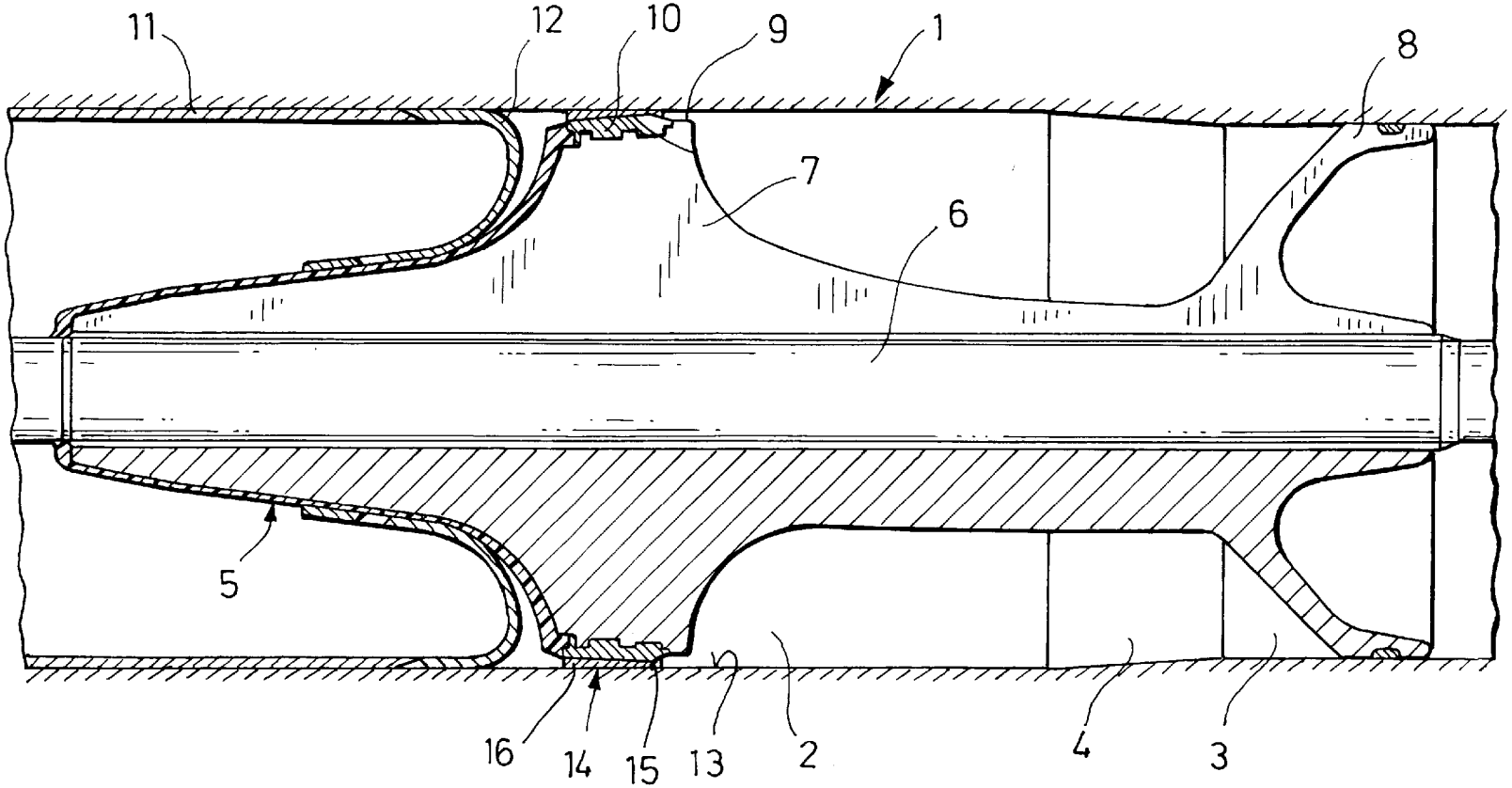
FIG. 1 is a longitudinal section through a chamber-side partial region of a gun barrel that is loaded with a projectile part, with a first embodiment of a sealing ring according to the invention being disposed on the guide band.

In FIG. 1, a gun barrel of a large-caliber, smooth-bore tank cannon, comprising a chamber 2 and a caliber barrel 3, is represented by 1. A conical transition region 4 is provided between the front-side of chamber 2 and the caliber barrel 3.

Disposed in the gun barrel 1 is a projectile 5 having a sub-caliber penetrator 6 and a propelling cage sabot 7 that is connected to the penetrator 6 in a form-fit and in a known manner, is segmented at the circumference. The propelling cage sabot 7 has two radial flanges 8, 9, with the rear-side flange 9 being provided on its outer circumferential surface with a guide band 10 that is adapted to the caliber of the barrel 3.

On the rear side, a combustible cartridge casing 11 adjoins the propelling cage sabot 7, and is connected to the propelling cage sabot 7 by a cartridge casing cover 12.

In accordance with the invention, to prevent propellant gases that are present after the cartridge has been ignited from flowing between the guide band 10 and the bordering barrel wall 13, a sealing ring 14 comprising a deformable plastic is disposed on the outer circumferential surface of the guide band 10 and generally corresponds to the inner diameter of the chamber 2.

After the cartridge has been ignited, the projectile 5 separates from the combustible cartridge casing 11, and the sealing ring 14 is compressed to the caliber diameter in the conical transition region 4, thereby producing the initial seal. As the projectile 5 is further accelerated, the front part 15 of the sealing ring 14 is destroyed, and the remaining portion 16 of the sealing ring 14 is flattened toward the back. The guide band 10 then assumes the function of sealing the chamber behind the propelling cage sabot 7 in a known manner.

Figure 2:
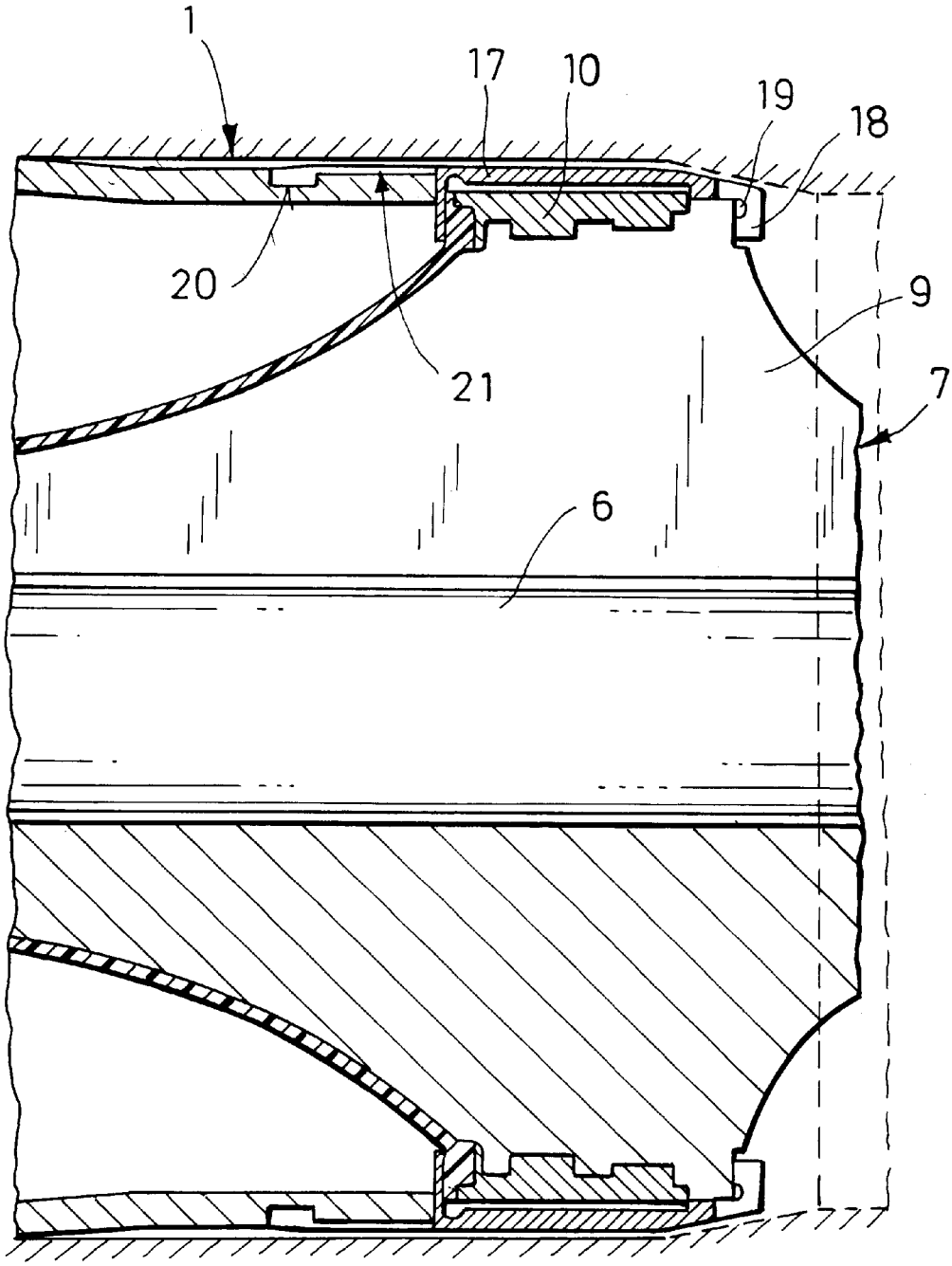
FIG. 2 is a projectile part with a second embodiment of a sealing ring according to the invention disposed on the guide band.

FIG. 2 illustrates the second flange 9 of the propelling cage sabot 7 with the guide band 10. Here, however, a sealing ring 17 is provided on the guide band 10, the ring being connected to the band 10 via a snap connection 18 and having a break-off or weakened point 19 at its circumference. On the rear side, the sealing ring 17 protrudes or extends past the guide band 10, and is connected to the cartridge casing 11 of a snap connection 20 and possibly a glued connection 21, so that a cartridge casing cover is omitted from this embodiment.

The invention is, of course, not limited to the exemplary embodiments shown in the figures.

The invention now being fully described, it will be apparent to one of ordinary skill in the art that many changes and modifications can be made thereto without departing from the spirit or scope of the invention as set forth herein.

What is claimed is:

1. A projectile to be fired from a gun having a cartridge chamber with a conical transition region to a caliber barrel that adjoins a front of the gun, the projectile comprising: a sub-caliber penetrator, a jettisonable propelling cage sabot connected to the penetrator, at least one guide band adapted to the caliber of the barrel secured to a rear portion of the sabot, and a cartridge casing disposed at the rear of the sabot, with the length of the projectile being such that the guide band is still located in the chamber of the barrel when the projectile is disposed in the gun barrel; and further comprising:

a sealing ring disposed on the outer circumferential surface of the guide band for sealing the caliber side of the chamber, with the sealing ring being formed of a plastic material selected such that at least a front part of the sealing ring is destroyed by radial pressure occurring in the conical transition region between the chamber and the caliber barrel as the projectile moves toward the muzzle of the gun barrel.

2. The projectile according to claim 1, wherein the sealing ring is provided with at least one break-off point at an end facing the transition region.

3. The projectile according to claim 1, further comprising a snap connection connecting the sealing ring to the guide band.

4. The projectile according to claim 1, wherein the sealing ring protrudes past the guide band at a rear side, and is provided with means for connecting the sealing ring to the cartridge casing.

5. The projectile according to claim 4, wherein the means for connecting the sealing ring and the cartridge casing to one another is a snap connection.

6. The projectile according to claim 5, wherein the sealing ring and the cartridge casing are additionally glued together in the region of the snap connection.

7. The projectile according to claim 1, wherein the sealing ring) comprises a non-reinforced thermoplastic plastic.

8. The projectile according to claim 7, wherein the sealing ring comprises PA6.

9. The projectile according to claim 1, wherein the cartridge chamber has an inner diameter greater than the caliber of the barrel; and, the sealing ring has an outer diameter that corresponds to the inner diameter of the cartridge chamber.

* * * * *